US005335482A

United States Patent [19]

Kinigakis et al.

[11] Patent Number: 5,335,482

[45] Date of Patent: Aug. 9, 1994

[54] LOADING OF CONTAINERS IN CARTONS

[75] Inventors: Panagiotis Kinigakis, West Windsor; William A. McGovern; John J. McGovern, both of Jamesburg, all of N.J.

[73] Assignee: Kraft General Foods, Inc., Northfield, Ill.

[21] Appl. No.: 18,648

[22] Filed: Feb. 17, 1993

[51] Int. Cl.[5] ..... B65B 5/08; B65B 21/04; B65B 21/18

[52] U.S. Cl. ..... 53/448; 53/247; 53/258; 53/260; 53/539; 53/543

[58] Field of Search ..... 53/443, 448, 475, 473, 53/247, 246, 248, 244, 260, 258, 255, 147, 158, 539, 543

[56] References Cited

U.S. PATENT DOCUMENTS

| | | | |
|---|---|---|---|
| 3,080,033 | 3/1963 | Scott et al. | 53/246 X |
| 3,142,948 | 8/1964 | Arnett | 53/246 X |
| 3,570,216 | 3/1971 | Frentzel | 53/248 X |
| 3,592,002 | 7/1971 | Alduk | 53/247 X |
| 3,634,996 | 1/1972 | Reichert et al. | 53/248 X |
| 3,869,843 | 3/1975 | Darrah, III et al. | 53/247 X |
| 4,050,217 | 9/1977 | Alduk . | |
| 4,078,361 | 3/1978 | Hartness et al. | 53/248 X |
| 4,231,213 | 11/1980 | Okazaki | 53/497 |
| 4,251,979 | 2/1981 | Horigome et al. | 53/543 |
| 4,259,826 | 4/1981 | Campbell | 53/543 |
| 4,300,330 | 11/1981 | Hartness | 53/539 |
| 4,389,832 | 6/1983 | Calvert | 53/534 X |
| 4,429,512 | 2/1984 | Pegon, Jr. | 53/534 |
| 4,756,139 | 7/1988 | Le Bras | 53/398 |
| 5,150,563 | 9/1992 | Hartness | 53/247 X |
| 5,267,426 | 12/1993 | Davis | 53/247 X |

*Primary Examiner*—James F. Coan

*Attorney, Agent, or Firm*—Thomas R. Savoie; Thomas A. Marcoux

[57] ABSTRACT

An apparatus and method for continuously loading containers into cartons in oriented two row arrays is provided. A supply delivers the containers individually to a depositing device for individually receiving respective containers. The depositing device is then moved to individually deposit the containers delivered thereto in a first collection device for collecting the containers in rows and columns corresponding to the array. The first collection device includes a matrix of dedicated channels similar to the array into which channels the depositing device deposits the containers in a sequential manner whereby the matrix is repeatedly filled with the containers row by row. Individually and alternately after each associated row of the matrix is filled, each row of containers in the first collection device is next delivered to a second collection device for collecting the containers in separated rows. The second collection device includes a respective bay for each respective row of the array of containers. After collecting the containers in two separated rows in the second collection device, and after presenting a carton adjacent the second collection device, the two separated rows of containers in the two bays of the second collection device are fed as the array into the presented carton. All of the containers in the rows in the second collection means are positively fed into the adjacent carton with a positive feed device which also serves to eliminate partially or unfilled containers from the array.

31 Claims, 2 Drawing Sheets

LOADING OF CONTAINERS IN CARTONS

FIELD OF THE INVENTION

The present invention relates generally to the loading of containers in open cartons, and more particularly to the loading of the containers in an oriented array into the cartons.

BACKGROUND OF THE INVENTION

Containers, such as the beverage container described in U.S. patent application Ser. No. 07/893,612, filed Jun. 5, 1992 and herein incorporated by reference, are typically packaged in a 2×3 array oriented vertically and parallel in an open topped carton (carton sleeve, sleeve package or other package, hereinafter referred to as carton) and surrounded by some type of shrink wrap. Plastic containers of this type are not of consistent shape and stiffness, and do not always stand up straight or roll straight. These containers also do not maintain orientation in any accumulation (horizontal or vertical), and the top of the container may be bent. During forming and filling, the bottoms may also be uneven due to bulging (one cause of containers which do not stand up straight). The cartoning of containers of this type is also complicated by the fact that an impact on the top may cause leakage at the twist-off closure seal, and scuffing of the soft plastic especially at the top is to be avoided.

In order to load containers of this type into cartons to form 6-packs, timing screws, flexible belts, drop chutes, brush guides, flighted conveyors, and counting mechanisms have failed to provide a consistent cartoning apparatus.

SUMMARY OF THE INVENTION

In accordance with the present invention, an apparatus and method for continuously loading containers into cartons in oriented two row arrays is provided. With the invention, a supply delivers the containers individually to a depositing means for individually receiving respective containers. The depositing means is then moved to individually deposit the containers delivered thereto in a first collection means for collecting the containers in rows and columns corresponding to the final array. The first collection means includes a matrix of dedicated channels similar to the array. The depositing means deposits the containers into respective channels in a sequential manner whereby the matrix is repeatedly (endlessly) filled with the containers row by row.

Individually and alternately after each associated row of the matrix is filled, each row of containers in the first collection means is next delivered to a second collection means for collecting the containers in separated rows. The second collection means includes a respective bay for each respective row of the array of containers. After collecting the containers in two separated rows in the second collection means, and after presenting a carton adjacent the second collection means, the two separated rows of containers in the two bays of the second collection means are fed as the array into the presented carton.

In a preferred embodiment of the invention, the depositing means is located vertically above the first collection means and the containers are dropped by gravity from the depositing means into the dedicated channels of the first collection means. In addition, the second collection means is located vertically below the first collection means and the rows of containers are dropped by gravity from the first collection means to the second collection means.

In the preferred embodiment, the first collection means includes a floor plate for each row of containers. Each respective floor plate is then reciprocally moved between two positions. In the first position, the floor plate serves to block a movement of containers out of the dedicated channels associated with a respective row as the associated row is filled. Subsequently, the floor plate is moved out of the blocking position when the associated row is filled so that the filled row of containers drops into an associated bay of the second collection means.

In this preferred embodiment, the containers are individually transported on a conveyor to the depositing means. The depositing means is located vertically below the conveyor and includes a drop chute into which containers from the conveyor are individually dropped. The drop chute is then sequentially indexed to direct each succeeding container passing therethrough to each respective succeeding dedicated channel in an endless manner.

It is a particular feature of the present invention that all of the containers in the rows in the second collection means are positively fed into the adjacent carton with a positive feed means. This positive feed means includes opposed rollers which engage opposite sides of two adjacent rows of the containers. The opposed rollers are then rotated together to feed the two rows together into the adjacent carton. Preferably, the opposed rollers are also shifted into forced engagement with the two rows of containers by a suitable shifting means to squeeze the containers together whereby any partially filled container is forced out of the array.

In addition, the rollers also preferably include an associated base plate attached thereto. Each base plate is moved with the associated roller. Thus, in an initial position before the rollers are rotated, the base plate is at the bottom of the associated bay to block a movement of containers out of the associated bays as the associated bay is filled. Thereafter, when both associated bays are filled and as the rollers begin rotation, the base plates are moved out of the blocking position so that the two rows of containers are moved by rotation of the rollers freely out of the bays. Preferably, shifting (e.g., reciprocating) rollers are provided and the rollers are circumferentially grooved so that a greater and more equal force of engagement is provided as the two rows are fed by the rollers.

It is an object of the present invention to provide for the reliable cartoning of containers quickly and automatically.

It is also an object of the present invention to provide for the reliable locating of every container from a supply in a standing position in a carton without damage or scuffing.

It is a further object of the invention to ensure a secure and reliable placement of all of the needed containers of the array into the carton without any missing containers and without distortion or damage to the carton.

It is another object of the present invention to provide a fully automatic and reliable cartoning of containers which operates at a high rate of speed, such as a delivery speed of 120 containers per minute.

Other features, advantages and objects of the present invention are stated in or apparent from the detailed description of a presently preferred embodiment of the invention found hereinbelow.

DETAILED DESCRIPTION OF THE PREFERRED EMBODIMENTS

Figure 1:
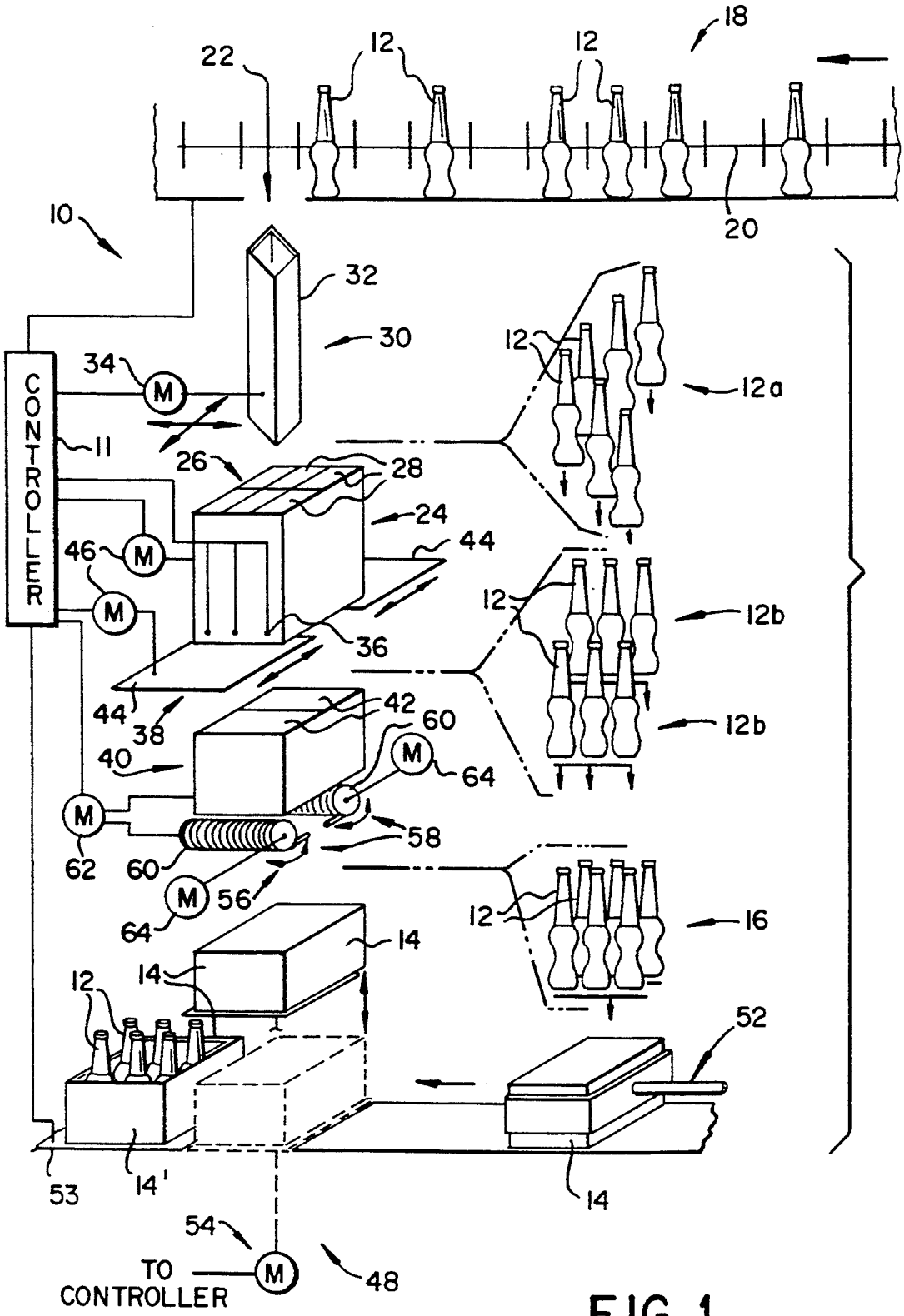
FIG. 1 is a schematic representation of the method steps and elements of the present invention.

With reference now to the drawings in which like numerals represent like elements, an apparatus 10 for continuously and reliably loading containers 12 into cartons 14 is schematically depicted in FIG. 1. Apparatus 10 is suitably controlled by a controller 11 whose connections to the various other elements are only schematically depicted. It will be appreciated that containers 12 are to be positioned in carton 14 in a predetermined array 16 of standing containers 12. While a 2×3 array (two rows and three columns) is depicted, array 16 could also be 2×2, 2×4, or any other size of columns as desired.

Apparatus 10 includes a supply 18 of containers 12. In this embodiment, supply 18 is a conveyor 20 controlled by controller 11 which individually transports the filled containers 12 therealong to a drop off 22 which is simply a hole in the floor along which containers 12 are conveyed. Beneath drop off 22 is a first collection means 24. First collection means 24 is used for collecting containers 12 in rows and columns corresponding to array 16. For this purpose, first collection means 24 includes a matrix 26 of dedicated channels 28 arranged similar to array 16.

In order to fill channels 28 of first collection means 24, a depositing means 30 is located vertically between drop off 22 and first collection means 24. Depositing means 30 is used to individually deposit respective containers 12 into channels 28 in a sequential manner so that channels 28 are repeatedly filled row by row. It will be appreciated that depositing means 30 includes a drop chute 32 into which containers 12 are individually dropped from conveyor 20 at drop off 22 in a standing position and without danger of damage to the top seal or scuffing of the container material. In order to deliver each succeeding container 12 to the next channel 28 to be filled, depositing means 30 also includes an indexing means 34 controlled by controller 11 for sequentially indexing drop chute 32 to direct each succeeding container 12 passing therethrough to each succeeding channel in an endless manner.

A set **12*a* of six containers 12 is schematically depicted to the side of depositing means 30 in a staggered arrangement to show that containers 12 are dropped sequentially and individually first along one row (the closest row of matrix 26) and then the other (and back to the initial row). Indexing means 34 is preferably electronically controlled actuators, although a camming mechanism would also be possible. It will also be appreciated that each channel of collection means 24 also includes a suitable sensor 36 which is actuated each time a container 12 passes from drop chute 32 to signal to controller 11 that drop chute 32 should be moved to the position over the next channel 28. By use of sensors 36, the absence of a container 12 in a normally filled position on conveyor 20 (a number of empty positions have been depicted in FIG. 1 to show this) does not result in an unfilled channel 28. Instead, drop chute 32 is only moved to the next channel 28 after a container has passed through drop chute 32** and filled the designated channel therebelow.

After each row of three containers 12 in first collection means 24 is filled, and as the other row of channels 28 is being filled, a first feeding means 38 is used to individually and sequentially feed each row to a second collection means 40. Second collection means 40 collects each set **12*b* of three containers 12 as a separate row in a respective bay 42. This feeding is also shown schematically by the sets 12*b* of containers 12 located between first collection means 24 and second collection means 40**.

In order to deliver each set **12*b* of containers 12 from first collection means 24, first feeding means 38 is conveniently a pair of floor plates 44 associated with each respective row of channels 28. Floor plates 44 are moved by respective moving means 46 controlled by controller 11. Moving means 46 thus move the respective floor plate 44 into position to block any movement of containers 12 deposited in the associated row of channels 28 as the row is being filled. Then, as soon as the row of channels 28 is filled, the associated floor plate 44 is moved out of the blocking position by moving means 46 so that the filled row of containers 12 drops by gravity as a set 12*b* into an associated bay 42 in second collection means 40 vertically therebelow. Moving means 46 then moves the floor plate 44 back to the blocking position in advance of the refilling of the associated row of channels 28**.

Provided below second collection means 40 is a presenting means 48. Presenting means 48 is used to present a open carton (sleeve) 14 to a position below second collection means 40 so that containers 12 collected in second collection means 40 in two separate sets **12*b* can be loaded in carton 14 as array 16. As shown, presenting means 48 preferably includes a shuttle means 52. Shuttle means 52 intermittently delivers set up (empty) cartons 14 to a lifting device 54 and at the same time pushes filled cartons 14' away from lifting device 54 onto a conveyor 53. Lifting device 54 serves to lift open carton 14 vertically to a position immediately below second collection means 40 and to bring filled carton 14' back to the level of shuttle means 52 to be pushed forward onto conveyor 53 as the next open carton is delivered to lifting device 54. Conveniently, lifting device 54 may be a platform with vertically reciprocating guide plates (not shown) to maintain carton 14 in a stationary position and a rectangular configuration as the containers 12 are loaded into each carton. The operation of platform 54 is controlled by controller 11**. Of course various other means of presenting empty cartons and removing loaded cartons may be employed in connection with the practice of this invention. Such means will be apparent to those skilled in the art and do not constitute elements of this invention.

The two sets **12*b* of containers 12 in second collection means 40 are fed into the presented carton 14 by a second feeding means 56. Second feeding means 56 thus feeds the separated rows of containers 12 from bays 42 as the array 16 as soon as both bays 42 are filled. It will be appreciated that lifting device 54 is needed because second feeding means 56 only delivers about the bottom half of containers 12 of array 16 and into carton 14** (as discussed in greater detail subsequently). Thus, when carton 14 is filled there is still an upper portion of containers 12 extending therefrom which prevents any horizontal movement of the filled carton 14'. In order to provide for the necessary clearance, it is therefore necessary to lower filled carton 14' before conveying filled carton 14' away. For convenience, it has been found easiest to provide this clearance movement by raising and lowering carton 14 with presenting means 48. However, it would also be possible to have a shuttle means 52 and a conveyor 53 without a presenting means and instead to lower and raise second collection means 40 to provide the necessary clearance after filling of carton 14.

Figure 2:
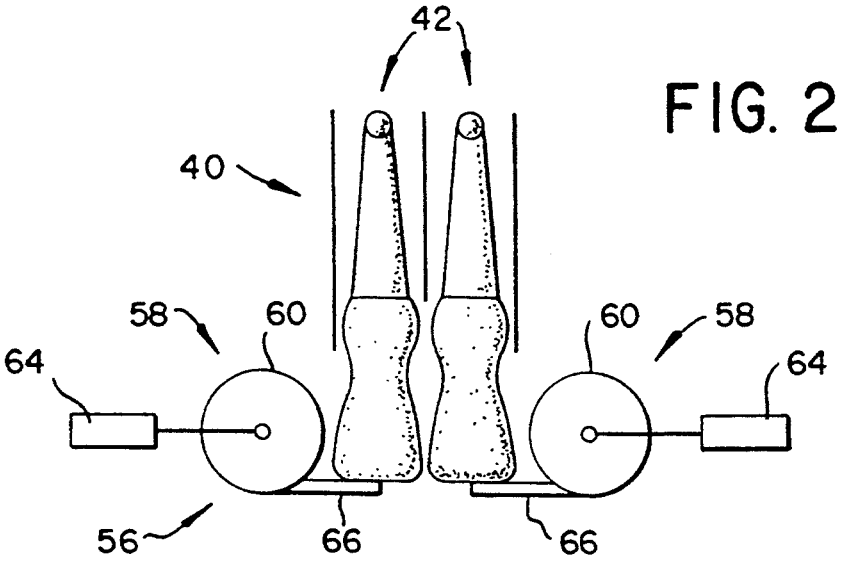
FIGS. 2, 3, and 4 are schematic elevation views of the feeding means depicted in FIG. 1 at three stages of operation.
Figure 3:
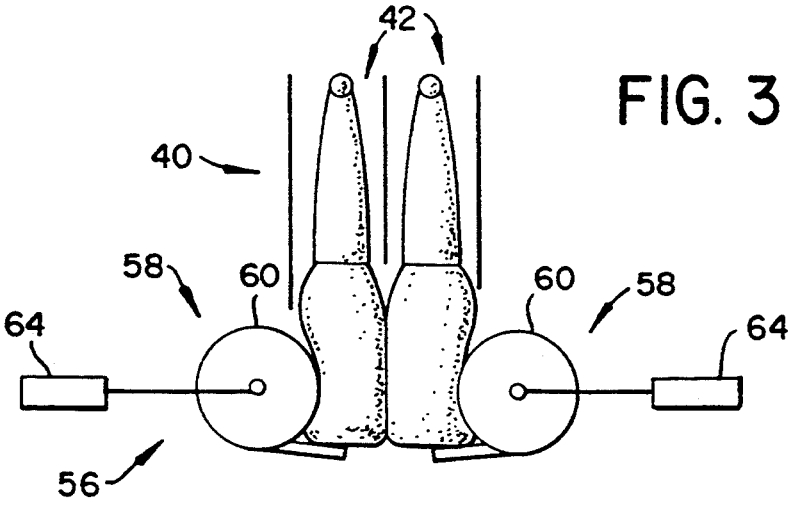
Figure 4:
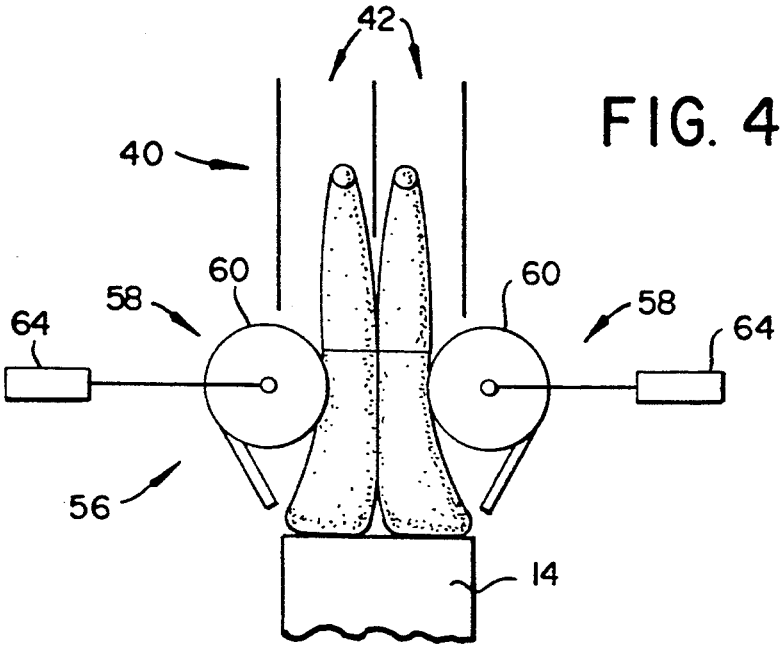

Second feeding means 56 is depicted in greater detail and in different stages of operation in FIGS. 2–4. As shown, second feeding means includes a positive feed means 58 which positively feeds both rows of containers 12 in bays 42 simultaneously into carton 14 as the array 16. Positive feed means 58 includes opposed rollers 60 which engage opposite sides of the two adjacent rows of containers 12 in bays 42. Rollers 60 are rotated by a rotating means 62 controlled by controller 11. Rotating means 62 rotates rollers 60 together and in opposite directions to feed the two rows of containers 12 in the associated bays 42 at the same time.

Positive feed means 58 also includes a respective shifting means 64 also controlled by controller 11. Initially, it will be appreciated that rollers 60 are provided with a clearance from containers 12 as containers 12 are dropped into bays 42; however, each roller is equipped with a guide plate 66 to prevent decent of containers 12 below the level of rolls 60 before the rolls are shifted. Thus guide plates 66 and 60 act to hold containers 12 in the proper position in bays 42 as shown in FIG. 2. Subsequently, shifting means 64 shifts each associated roller 60 from the guiding or clearance position into forced engagement with the adjacent containers 12 before rotation is initiated, as shown in FIG. 3. It should be appreciated that rollers 60 are mounted for reciprocating, horizontal movement and are circumferentially grooved for better traction on containers 12. Thus, as containers 12 are driven as array 16 from second collection means 40 by rotation of rollers 60, containers 12 are positively driven and squeezed together. With containers 12 being somewhat pliable and (almost completely) filled with a liquid, containers 12 are thus easily propelled together into the presented carton 14 as shown in FIG. 4.

However, if any of containers 12 are not filled to the desired level (and thus should not be packaged for sale with the other containers), the squeezing action of rollers 60 will cause any partially-filled container to be deformed in a different manner than the correctly-filled containers. When this occurs, the partially filled container is then not properly driven into present carton 14. Instead, partially filled container is either not completely inserted and misaligned so as to be easily recognizable or the partially filled container falls to the side of carton 14 as the rest of containers 12 are properly delivered. In either event, the need for corrective action with the (incorrectly filled) carton is easily determined and appropriate action easily taken.

The amount of pressure to be applied to containers 12 by rollers 60 during the positive feeding step in order to misfeed incorrectly-filled containers will vary with the differing sizes and shapes of containers that may be utilized with this invention. It is therefore desirable that shifting means 64 be adjustable with respect to the extent of horizontal movement provided to rollers 60.

As best shown in FIGS. 2–4, rollers 60 each have a base plate 66 attached tangentially thereto. Base plates 66 are initially positioned at the bottom of an associated bay 42 as the associated set 12*b* of containers 12 is deposited in the associated bay 42 from first collection means 24. Thus, base plates 66 block the bottoms of bays 42 and prevent containers 12 therein from falling out of bays 42. However, after both bays 42 are filled with the rows of containers 12, and after rollers 60 are shifted into engagement with containers 12, base plates 66 are rotated out of the blocking position by the rotation of rollers 60 which simultaneously drive containers 12 into carton 14 as shown in FIG. 4.

In operation, apparatus 10 continuously functions in the following manner. As conveyor 20 moves containers 12 therealong, each successive container 12 falls vertically downward into drop chute 32 upon reaching drop off 22. As each container 12 is received in drop chute 32, drop chute 32 directs the newly received container 12 to an appropriate and sequential one of channels 28 in first collection means 24. This is accomplished using indexing means 34 and sensors 36, with channels 28 being filled row by row. Drop chute 32 thus moves in a stepwise rectangular pattern to effect this row by row filling in an endless manner, and drop chute 32 only moves to alignment with the next channel 28 after a container has passed therethrough and is sensed by sensors 36.

After one row in first collection means 24 is filled, the associated floor plate 44 is moved by moving means 46 from the position where containers 12 are supported in the associated dedicated channels 28 to the position where containers 12 are not supported and thus fall from dedicated channels 28. This effects a feeding of first one row and then another row to second collection means 40. Two separated rows of containers 12 are thus (continuously) collected in second collection means 40, and at the same time an empty carton 14 is presented below second collection means 40. When both rows of containers 12 are in position in second collection means 40 and carton 14 is in place, the two rows of containers 12 are fed as the array 16 into carton 14 by second feeding means 56. This is done by driving both rows of containers 12 using positive feed means 58.

Driving of both rows of containers 12 by positive feed means 58 is effected after rollers 60 of positive feed means 58 are shifted into forced engagement with containers 12 and containers 12 are squeezed together as shown in FIGS. 3. Then, by rotation of rollers 60, both rows of containers 12 are driven downward as shown in FIG. 4. This shifting causes a force to be applied to containers 12 as containers 12 are driven as a unit. This positive feeding of containers 12 proceeds smoothly so long as all containers 12 in the array 16 are filled (as normally expected). However, should one container 12 not be filled or only partially filled (as by inadvertent leakage or a misfilling), the squeezing and feeding of the other properly filled containers 12 causes the partially filled container to be deflected out of line and/or lag in decent relative to the rest of the array and to consequently misfeed into presented carton 14. This misfeeding is then easily noted and corrected for. Rotation of rollers 60 is stopped and rollers 60 are shifted (i.e., retracted) to their open position after the containers 12 have passed out of contact with rollers 60 and/or containers 12 are fully inserted into presented carton 14.

After containers 12 have moved below the level of rollers 60, the rollers are rotated in the opposite direction to return base plates 66 to their initial position.

While apparatus 10 has been only schematically depicted in the drawings, it will be appreciated by those of ordinary skill in the art that various other elements would be included. For example, guides along the path of containers 12 between each of the mentioned elements could be provided as needed to assure proper delivery. Suitable guide plates could be mounted on presenting means 48 to provide support adjacent the long sides of carton 14 as it is loaded with array 16 to prevent movement or damage to carton 14 as array 16 is delivered therein.

It will also be appreciated that other sensors besides sensors 36 would be associated with controller 11 to make sure that containers 12 are properly delivered to each collection means and to signal when the next step of operation is ready to be commence. Further, as apparatus 10 is designed for use with beverage bottles, those of ordinary skill will also appreciate that all elements would be designed to be washed down easily and access provided in case of jamming (such as by an access door for drop chute 32).

While the present invention has been described with respect to an exemplary embodiment thereof, it will be understood by those of ordinary skill in the art that variations and modifications can be effected within the scope and spirit of the invention.

What is claimed is:

1. An apparatus for continuously loading containers into cartons in oriented arrays comprising:

a supply of the containers;

a first collection means for collecting the containers in rows and columns corresponding to the array, said first collection means including a matrix of dedicated channels similar to the array;

a depositing means for individually depositing respective containers into said channels in a sequential manner from said supply of the containers whereby said matrix is repeatedly filled with the containers row by row;

a second collection means for collecting the containers in separated rows, said second collection means including respective bays for each row of the array of containers;

a first feeding means for individually and sequentially feeding each row of containers in said first collection means to an associated said bay of said second collection means after each associated row of said matrix is filled by said depositing means;

a presenting means for presenting a carton adjacent said second collection means; and a second feeding means for feeding the separated rows of containers in said bays of said second collection means as the array into the presented carton after said bays of said second collection means are filled with the separated rows.

2. An apparatus for loading containers as claimed in claim 1 wherein said depositing means is located vertically above said first collection means whereby the containers are dropped by gravity from said depositing means into the dedicated channels of said first collection means; and wherein said second collection means is located vertically below said first collection means whereby said first feeding means feeds the rows of containers by gravity from said first collection means to said second collection means.

3. An apparatus for loading containers as claimed in claim 2 wherein said first collection means includes a floor plate for each row of containers and a moving means for moving each respective floor plate into position to block a movement of containers out of the dedicated channels associated with a respective row as the associated row is filled and out of position when the associated row is filled so that the filled row of containers drops into an associated said bay of said second collection means.

4. An apparatus for loading containers as claimed in claim 2 wherein said supply is a conveyor which individually transports the containers to said depositing means; and wherein said depositing means is located vertically below said conveyor and includes a drop chute into which containers from said conveyor are individually dropped and an indexing means for sequentially indexing said drop chute to direct each succeeding container passing therethrough to each respective succeeding dedicated channel in an endless manner.

5. An apparatus for loading containers as claimed in claim 1 wherein said second feeding means includes a positive feed means for positively feeding all of the containers in the rows in said second collection means into the adjacent carton.

6. An apparatus for loading containers as claimed in claim 5 wherein said positive feed means includes opposed rollers which engage opposite sides of two adjacent rows of the containers and a rotating means for rotating said opposed rollers together to feed the two rows together into the adjacent carton.

7. An apparatus for loading containers as claimed in claim 6 wherein said positive feed means also includes a shifting means for shifting said opposed rollers into forced engagement with the two rows of containers to squeeze the containers together whereby any partially filled container is forced out of the array.

8. An apparatus for loading containers as claimed in claim 7 wherein said rollers also include an associated base plate attached thereto which said base plates are positioned in associated said bays to block a movement of containers out of the associated bays as the associated bay is filled and out of position when the associated bay is filled so that the two rows of containers are moved by rotation of said rollers.

9. An apparatus for loading containers as claimed in claim 8 wherein said rollers are circumferentially grooved.

10. An apparatus for continuously loading containers into cartons in oriented arrays of only two rows comprising:

a supply of the containers;

a first collection means for collecting the containers in two rows and columns corresponding to the array, said first collection means including a matrix of dedicated channels similar to the array and located vertically below said supply;

a depositing means located between said supply and said matrix of said first collection means for individually depositing respective containers into said channels in a sequential manner from said supply of the containers whereby said matrix is repeatedly filled with the containers row by row, said depositing means including a drop chute into which containers from said supply are individually dropped and an indexing means for sequentially indexing said drop chute to direct each succeeding container passing therethrough to each respective succeeding dedicated channel in an endless manner;

a second collection means for collecting the containers in two separated rows, said second collection means including two respective bays for said two rows of containers which are located vertically below said first collection means;

a first feeding means located between said matrix of said first collection means and said bays of said second collection means for individually and sequentially feeding each row of containers in said first collection means to an associated said bay of said second collection means after each associated row of said matrix is filled by said depositing means;

a presenting means for presenting a carton adjacent and below said bays of said second collection means; and a second feeding means for feeding the two separated rows of containers in said bays of said second collection means as the array vertically downward into the presented carton after said bays of said second collection means are filled with the two separated rows, said second feeding means including a positive feed means for positively feeding all of the containers in the two rows in said second collection means into the adjacent carton.

11. An apparatus for loading containers as claimed in claim 10 wherein said first collection means includes a floor plate for each row of containers and a moving means for moving each respective floor plate into position to block a movement of containers out of the dedicated channels associated with a respective row as the associated row is filled and out of position when the associated row is filled so that the filled row of containers drops into an associated said bay of said second collection means.

12. An apparatus for loading containers as claimed in claim 10 wherein said supply is a conveyor which individually transports the containers to said depositing means.

13. An apparatus for loading containers as claimed in claim 12 wherein said positive feed means includes a) opposed rollers which engage opposite sides of the two adjacent rows of the containers, b) a rotating means for rotating said opposed rollers together to feed the two rows together into the adjacent carton, and c) a shifting means for shifting said opposed rollers into forced engagement with the two rows of containers to squeeze the containers together whereby any partially filled container is forced out of the array.

14. An apparatus for loading containers as claimed in claim 13 wherein said rollers also include a base plate attached thereto which are positioned in associated said bays to block a movement of containers out of the associated bays as the associated bay is filled and out of position when the associated bay is filled so that the two rows of containers are moved by rotation of said rollers.

15. An apparatus for loading containers as claimed in claim 14 wherein said rollers are circumferentially grooved.

16. A method for continuously loading containers into cartons in oriented two row arrays comprising the steps of:

delivering the containers individually to a depositing means for individually receiving respective containers;

moving the depositing means to individually deposit the containers delivered thereto in a first collection means for collecting the containers in rows and columns corresponding to the array, the first collection means including a matrix of dedicated channels similar to the array into which channels the depositing means deposits the containers in a sequential manner whereby the matrix is repeatedly filled with the containers row by row;

feeding, individually and alternately after each associated row of the matrix is filled, each row of containers in the first collection means to a second collection means for collecting the containers in separated rows with the second collection means including a respective bay for each respective row of the array of containers;

collecting the containers in two separated rows in the second collection means;

presenting a carton adjacent the second collection means; and feeding the two separated rows of containers in the two bays of the second collection means as the array into the presented carton after the bays of the second collection means are filled with the two separated rows.

17. A method for loading containers as claimed in claim 16 wherein the depositing means is located vertically above the first collection means and said delivering step includes the step of dropping the containers by gravity from the depositing means into the dedicated channels of the first collection means; and wherein the second collection means is located vertically below the first collection means and said row feeding step includes the step of dropping the rows of containers by gravity from the first collection means to the second collection means.

18. A method for loading containers as claimed in claim 17 wherein the first collection means includes a floor plate for each row of containers and the row feeding step includes the step of moving each respective floor plate into position to block a movement of containers out of the dedicated channels associated with a respective row as the associated row is filled and out of the blocking position when the associated row is filled so that the filled row of containers drops into an associated the bay of the second collection means.

19. A method for loading containers as claimed in claim 17 wherein the delivering step includes the step of individually transporting on a conveyor the containers to the depositing means; and wherein the depositing means is located vertically below the conveyor and includes a drop chute into which containers from the conveyor are individually dropped and said moving step includes the step of sequentially indexing the drop chute to direct each succeeding container passing therethrough to each respective succeeding dedicated channel in an endless manner.

20. A method for loading containers as claimed in claim 16 wherein the array feeding step includes the step of positively feeding all of the containers in the rows in the second collection means into the adjacent carton with a positive feed means.

21. A method for loading containers as claimed in claim 20 wherein the positive feed means includes opposed rollers which engage opposite sides of two adjacent rows of the containers and said array feeding step includes the step of rotating the opposed rollers together to feed the two rows together into the adjacent carton.

22. A method for loading containers as claimed in claim 21 wherein said positively feeding step also includes the step of shifting the opposed rollers into forced engagement with the two rows of containers to squeeze the containers together whereby any partially filled container is forced out of the array.

23. A method for loading containers as claimed in claim 22 wherein the rollers also include an associated base plate attached thereto and said positively feeding step includes the step of moving the base plates to a position in associated bays to block a movement of containers out of the associated bays as the associated bay is filled and out of position when the associated bay is filled so that the two rows of containers are moved by rotation of the rollers.

24. An apparatus for continuously loading arrays of only two rows of containers into cartons comprising:

a collection means for collecting the containers in two vertically separated rows, said collection means including two respective vertical bays in which said two rows of containers are received;

a presenting means for presenting a carton adjacent and below said bays of said collection means; and a feeding means for feeding the two separated rows of containers in said bays of said collection means as the array into the presented carton after said bays of said collection means are filled with the two separated rows, said feeding means including a positive feed means for positively feeding all of the containers in the two rows in said collection means into the adjacent carton.

25. An apparatus for loading containers as claimed in claim 24 wherein said positive feed means includes opposed rollers which engage opposite sides of two adjacent rows of the containers and a rotating means for rotating said opposed rollers together to feed the two rows together into the adjacent carton.

26. An apparatus for loading containers as claimed in claim 25 wherein said positive feed means also includes a shifting means for shifting said opposed rollers into forced engagement with the two rows of containers to squeeze the containers together whereby any partially filled container is forced out of the array.

27. An apparatus for loading containers as claimed in claim 26 wherein said rollers also include an associated base plate attached thereto which said base plates are positioned in associated said bays to block a movement of containers out of the associated bays as the associated bay is filled and out of position when the associated bay is filled so that the two rows of containers are moved by rotation of said rollers.

28. A method for continuously loading arrays of only two rows of containers into cartons comprising the steps of:

collecting the containers in two vertically separated rows in a collection means, the collection means including two respective vertical bays in which the two rows of containers are received;

presenting a carton adjacent and below the bays of the collection means; and positively feeding with a positive feed means all of the containers in the two separated rows of containers in the bays of the collection means as the array into the presented carton after the bays of the collection means are filled with the two separated rows.

29. A method for loading containers as claimed in claim 28 wherein the positive feed means includes opposed rollers; and wherein said positively feeding step includes the steps of engaging the opposed rollers on opposite sides of two adjacent rows of the containers and rotating of the opposed rollers together to feed the two rows together into the adjacent carton.

30. A method for loading containers as claimed in claim 29 wherein said positively feeding step also includes the step of shifting the opposed rollers into forced engagement with the two rows of containers to squeeze the containers together whereby any partially filled container is forced out of the array.

31. A method for loading containers as claimed in claim 30 wherein the rollers also include an associated base plate attached thereto and said positively feeding step includes the step of moving the base plates to a position in associated bays to block a movement of containers out of the associated bays as the associated bay is filled and out of position when the associated bay is filled so that the two rows of containers are moved by rotation of the rollers.

* * * * *